US007717548B2

(12) United States Patent
Tatsumi et al.

(10) Patent No.: US 7,717,548 B2
(45) Date of Patent: May 18, 2010

(54) INK CONTAINER AND INK JET RECORDING APPARATUS

(75) Inventors: Setsuji Tatsumi, Kanagawa (JP); Yasuhiko Kachi, Kanagawa (JP); Yoshihiro Ito, Saitama (JP); Satoru Okamoto, Saitama (JP)

(73) Assignee: Fujifilm Corporation, Tokyo (JP)

( * ) Notice: Subject to any disclaimer, the term of this patent is extended or adjusted under 35 U.S.C. 154(b) by 371 days.

(21) Appl. No.: 11/475,101

(22) Filed: Jun. 27, 2006

(65) Prior Publication Data

US 2006/0290753 A1 Dec. 28, 2006

(30) Foreign Application Priority Data

Jun. 28, 2005 (JP) ..... 2005-188848

(51) Int. Cl.
*B41J 2/175* (2006.01)

(52) U.S. Cl. ..... 347/85

(58) Field of Classification Search ..... 347/86
See application file for complete search history.

(56) References Cited

U.S. PATENT DOCUMENTS 5,757,390 A * 5/1998 Gragg et al. ..... 347/7
6,058,984 A * 5/2000 Sato ..... 141/7
6,164,766 A * 12/2000 Erickson ..... 347/85
6,447,093 B1 * 9/2002 Asakawa et al. ..... 347/21
6,517,175 B2 * 2/2003 Kanaya et al. ..... 347/7
2003/0001934 A1 * 1/2003 Kitabatake et al. ..... 347/86

FOREIGN PATENT DOCUMENTS

JP 2003-300331 A 10/2003

* cited by examiner

*Primary Examiner*—Stephen D Meier
*Assistant Examiner*—Alexander C Witkowski
(74) *Attorney, Agent, or Firm*—Birch, Stewart, Kolasch & Birch, LLP

(57) ABSTRACT

An ink cartridge is partitioned into a negative pressure generator chamber containing a negative pressure generator and a storage chamber containing an ink bag. The ink bag stores ink and supplies the ink to the negative pressure generator chamber through an ink port. The negative pressure generator absorbs and holds the ink by its capillary force, to keep pressure inside nozzles of a recording head negative to atmospheric pressure. Through a first air introduction hole, the air is introduced into the negative pressure generator chamber as the ink in the negative pressure generator chamber decreases. Through a second air introduction hole, the air is introduced into the storage chamber as the ink in the ink bag decreases. So variations in pressure inside the nozzles are suppressed, which makes ink discharge from the nozzles stable.

23 Claims, 13 Drawing Sheets

INK CONTAINER AND INK JET RECORDING APPARATUS

FIELD OF THE INVENTION

The present invention relates to an ink container for supplying ink to an ink jet type recording head, and an ink jet recording apparatus using the ink container.

BACKGROUND ARTS

An ink jet recording apparatus has been known, which has a recording head for discharging ink as droplets onto a recording paper to print an image. The ink jet recording apparatus is provided with at least an ink container containing ink, to supply the ink from the ink container to the recording head. In an example, the recording head is provided with at least a nozzle and an oscillation plate driven by a piezoelectric element. Making use of pressure change in the nozzle, which is caused by oscillating the oscillation plate, the recording head sucks the ink from the ink container into the nozzle, and discharges the ink through an ink outlet of the nozzle.

Because the ink is a consumable material, the ink container is often formed as a cartridge that is removably attached to the ink jet recording apparatus, so the ink may be supplied conveniently. When the ink contained in the cartridge type ink container, hereinafter called the ink cartridge, is used up, the empty ink cartridge is replaced with another that is fully filled with the ink. In an ink cartridge loading section of the recording apparatus, an ink supply needle is disposed for supplying the ink from the ink cartridge to the recording head. The ink cartridge is connected to the nozzles of the recording head through an ink supply path, including the ink supply needle.

An ink jet recording apparatus disclosed in Japanese laid-open Patent Application No. 2003-300331 uses an ink cartridge that consists of a flexible ink bag and a case protecting the ink bag. If the ink is exposed to the air, the air will be solved in the ink, forming air bubbles in the ink, or some components of the ink react with oxygen, deteriorating the ink. To keep the air out of the ink, the ink cartridge uses the air-tight ink bag.

It is known in the art that the pressure inside the nozzle of the recording head, hereinafter called the nozzle internal pressure, is kept negative relative to the atmosphere, in order to prevent the ink leakage through the nozzle, which would otherwise be caused by the weight of the ink. Where the ink cartridge is placed above the recording head, the nozzle internal pressure is so raised by the weight of the ink contained in the ink cartridge, that it cannot keep the negative value relative the atmospheric pressure without any countermeasure. According to the above prior art, the air in a room between the ink bag and the case is sucked by a suction pump to reduce the pressure in the room, so that the nozzle internal pressure is kept negative relative to the atmospheric pressure.

As the ink in the ink bag is consumed, the pressure applied to the nozzle by the ink weight decreases, so the negative pressure in the nozzle would become too large if the case internal pressure is kept at the initial negative value. In that case, the ink discharged from the nozzle would be improperly reduced, lowering the print density improperly. To avoid this problem, the above-mentioned prior art suggests providing a pressure sensor for measuring the nozzle internal pressure, and controlling the amount of suction by the suction pump depending upon the measured nozzle internal pressure. Thereby, the nozzle internal pressure is kept in a proper range.

However, because the conventional method of controlling the nozzle internal pressure by controlling the pressure of the room between the ink bag and the case needs the suction pump, the apparatus for this method tends to have a complicated structure. So an alternative device that ensures stability of ink discharging property of the recording head without complicating the structure of the ink container has been desired.

SUMMARY OF THE INVENTION

In view of the foregoing, a primary object of the present invention is to provide an ink container that is simple in structure and useful for stabilizing the ink discharging operation of the ink jet recording apparatus.

Another object of the present invention is to provide an ink jet recording apparatus for use with the ink container.

To achieve the above and other objects in an ink container containing ink in a case having an ink outlet at its bottom, the present invention suggests an ink container that comprises a negative pressure generator chamber that contains a negative pressure generator and has the ink outlet formed through a bottom portion, the negative pressure generator absorbing and holding the ink by its capillary force, to keep pressure inside the nozzles negative to atmospheric pressure while the ink outlet is connected to the recording head; a storage chamber that is separated from said negative pressure generator chamber by a partition wall and contains an air-tight ink bag storing the ink; an ink port formed through the partition wall and joined to an ink spout of the ink bag to connect the ink bag to the negative pressure generator chamber; a first air introduction hole for introducing air into the negative pressure generator chamber as the ink in the negative pressure generator chamber decreases; and a second air introduction hole for introducing air into the storage chamber as the ink in the ink bag decreases.

The case of the ink container preferably comprises a case body having the negative pressure generator chamber and the storage chamber, and a top lid for closing an open top of the case body, wherein the first and second air introduction holes are formed through the top lid.

According to a preferred embodiment, an ink bag has accordion folds that extend substantially horizontally, so that the ink bag is folded down along the accordion folds as the ink in the ink bag decreases and the air is introduced into the storage chamber.

Preferably, the ink port may be switched over between an opening position to permit the ink flowing through the ink port, and a closing position to stop the ink from flowing through the ink port, by use of an ink port opening closing mechanism.

According to the present invention, an ink jet recording apparatus comprises an ink jet type recording head discharging ink through nozzles in accordance with image data to print an image; an ink container for supplying the recording head with the ink, the ink container being disposed above the recording head, and comprising a negative pressure generator chamber containing a negative pressure generator that absorbs and holds the ink by its capillary force to keep pressure inside the nozzles negative to atmospheric pressure, a storage chamber storing the ink to be supplied to the negative pressure generator chamber, and an ink port for supplying the ink from the storage chamber to the negative pressure generator chamber; an ink port opening closing mechanism for switching over the ink port between an opening position to permit the ink flowing through the ink port, and a closing position to stop the ink from flowing through the ink port; and a control device for controlling the ink port opening closing mechanism.

According to a preferred embodiment, the ink jet recording apparatus further comprises an ejected ink amount detecting device for detecting an ejected amount of ink from the recording head, wherein the control device controls the ink port opening closing mechanism to supply the ink to the negative pressure generator chamber by an amount according to the ejected amount of the ink.

According to another preferred embodiment, the ink jet recording apparatus further comprises an ink level detector for detecting that the ink contained in the negative pressure generator chamber goes below a predetermined reference level, wherein the control device controls the ink port opening closing mechanism to supply the ink by a given amount to the negative pressure generator chamber when the ink level goes below the reference level in the negative pressure generator chamber.

Providing the ink container with the negative pressure generator chamber and the storage chamber containing the ink bag suppresses variations in pressure inside the nozzles and thus stabilizes ink discharging operation of the recording head.

Providing the ink port opening closing mechanism still more suppresses variations in pressure inside the nozzles and thus improves stability of the ink discharging operation.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
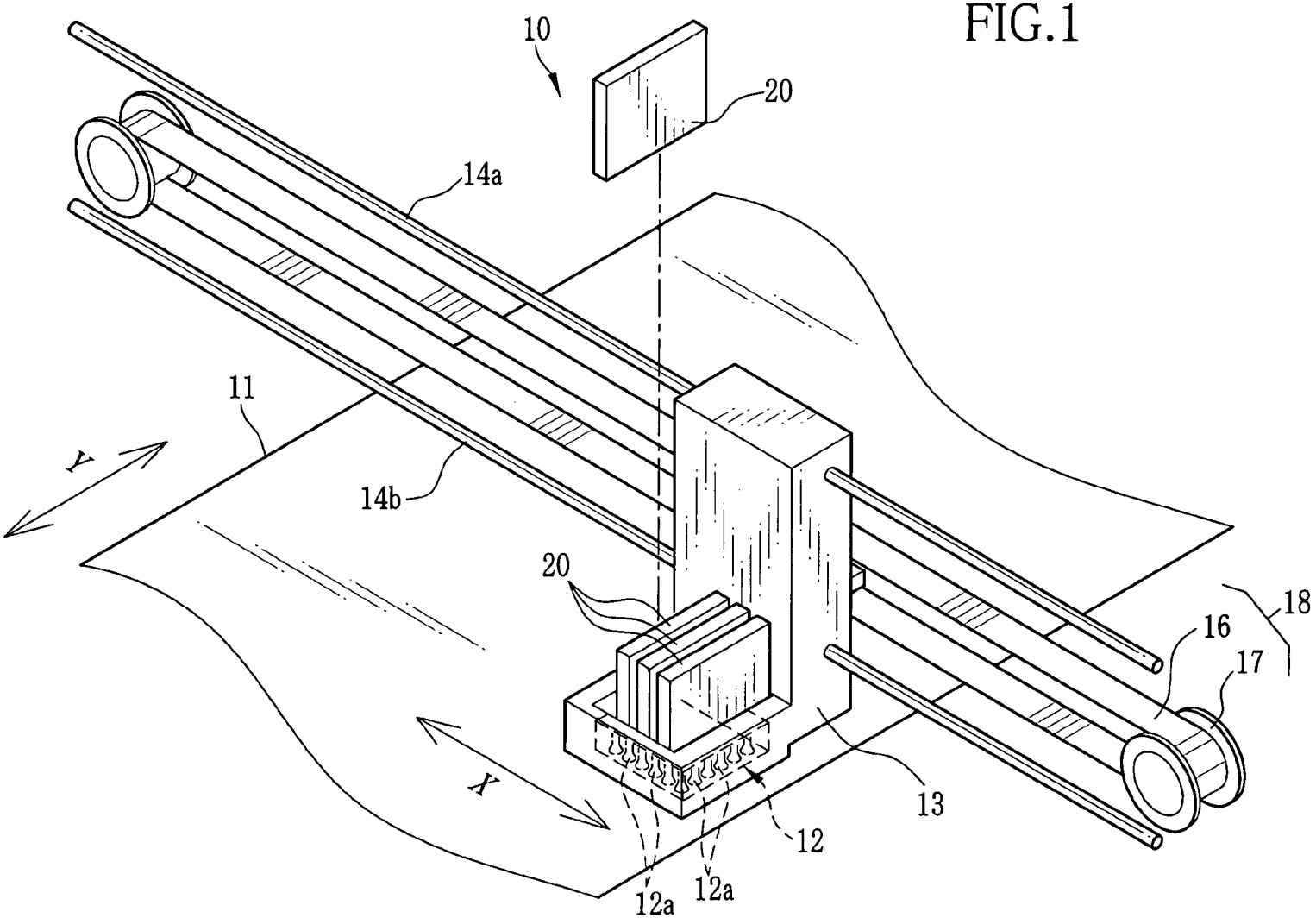
FIG. 1 is an explanatory diagram illustrating essential elements of an ink jet recording apparatus according to an embodiment of the invention.

An ink jet recording apparatus 10 shown in FIG. 1 is provided with a recording head 12 that discharges ink toward a paper sheet 11 to print images thereon. The recording head 12 is provided with a plurality of nozzles 12*a* for discharging the ink from individual outlets. The outlets of the nozzles 12*a* are aligned in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X. The discharging surface is exposed through an opening formed through a bottom of the carriage 13. While reciprocating in the widthwise direction of the paper sheet 11 together with the carriage 13, the recording head 12 records an image in a line sequential fashion. Each time the recording head 12 makes one lap to record a line of the image, the recording paper 11 is fed by not-shown conveyer rollers in a sub scanning direction Y, that is orthogonal to the main scanning direction X, by a length corresponding to a width of each image line as recorded by the recording head 12. Thus, a frame of image is recorded line after line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 20, e.g. four cartridges containing inks of four different colors: yellow, magenta, cyan and black.

The carriage 13 is provided with not-shown slots, into which the ink cartridges 20 are plugged. In each slot, there is provided an ink supply needle 36, see FIG. 2, having a through-hole as a path for supplying the ink to the recording head 12. When the ink cartridge 20 is plugged in the slot, the ink supply needle 36 is stuck into an ink outlet 31 that is formed on a bottom of the ink cartridge 20, so the ink contained in the ink cartridge 20 is supplied through the ink supply nozzle 36 to the recording head 12. In the recording head 12, not-shown pressure rooms and oscillation plates are provided in one-to-one relationship with the nozzles 12*a*. The oscillation plates are driven individually by piezoelectric elements, to change volume of the pressure room. Thereby, the ink in the ink cartridge 20 is sucked into the nozzles 12*a*, and is ejected from the outlets of the nozzles 12*a*.

Figure 2:
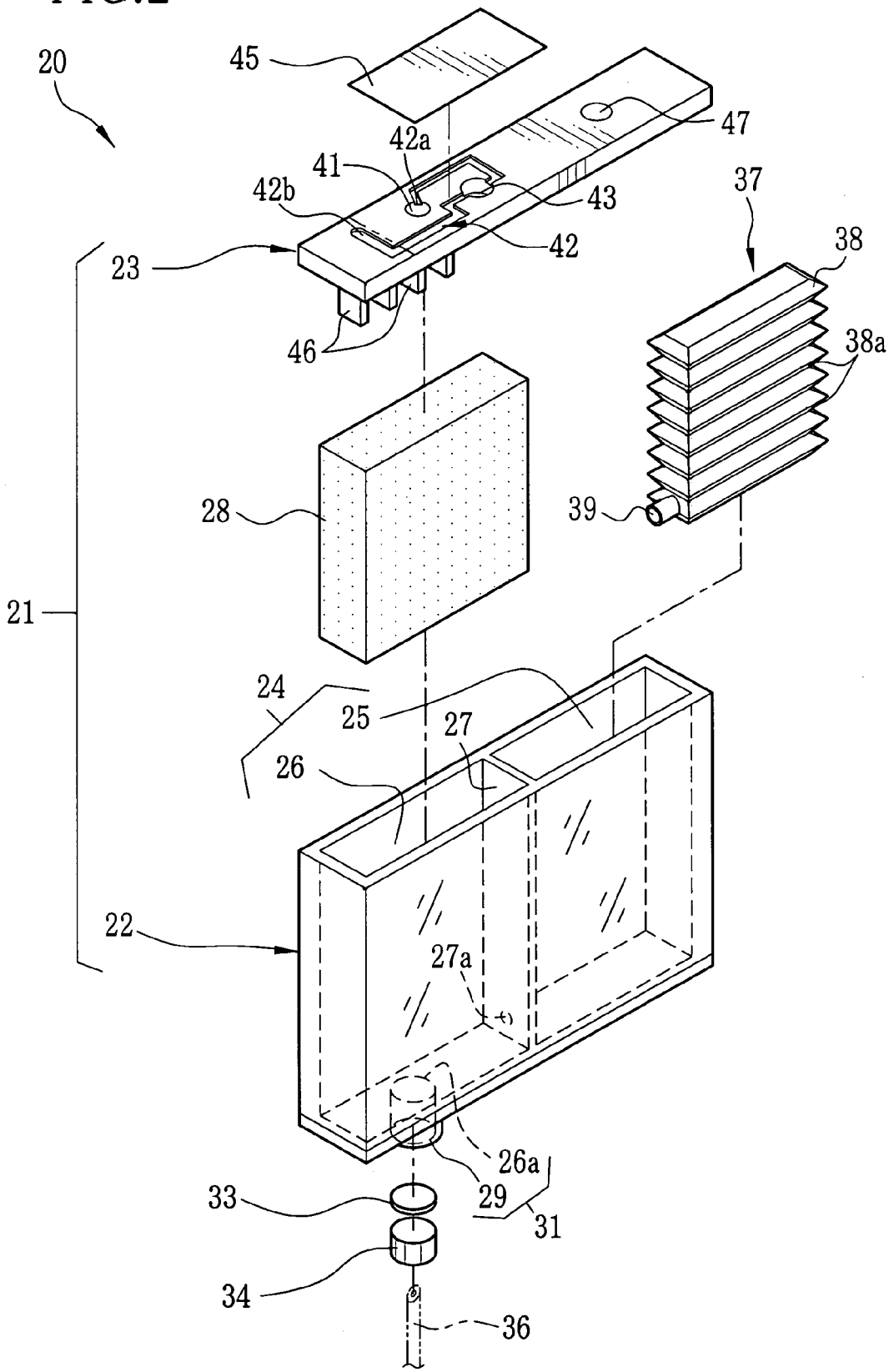
FIG. 2 is an exploded perspective view of an ink cartridge used in the ink jet recording apparatus of FIG. 1.

As shown in FIG. 2, a case 21 of the ink cartridge 20 consists of a case body 22 formed with ink chambers 24 for storing the ink, and a top lid 23 for closing an open top of the case body 22. After the case body 22 is filled with the ink, the top lid 23 is affixed to the case body 22, for example, by welding. Thereby, the ink is prevented from leaking through the open top of the case body 22. The case body 22 is formed from a transparent plastic or the like, so the remaining amount of the ink in the ink cartridge 20 is visible from outside.

The ink chambers 24 consist of an negative pressure generator chamber 26 holding a negative pressure generator 28 that absorbs and holds the ink by its capillary force, and a storage chamber 25 for storing the ink. The negative pressure generator chamber 26 and the storage chamber 25 are partitioned by a partition wall 27.

Figure 3:
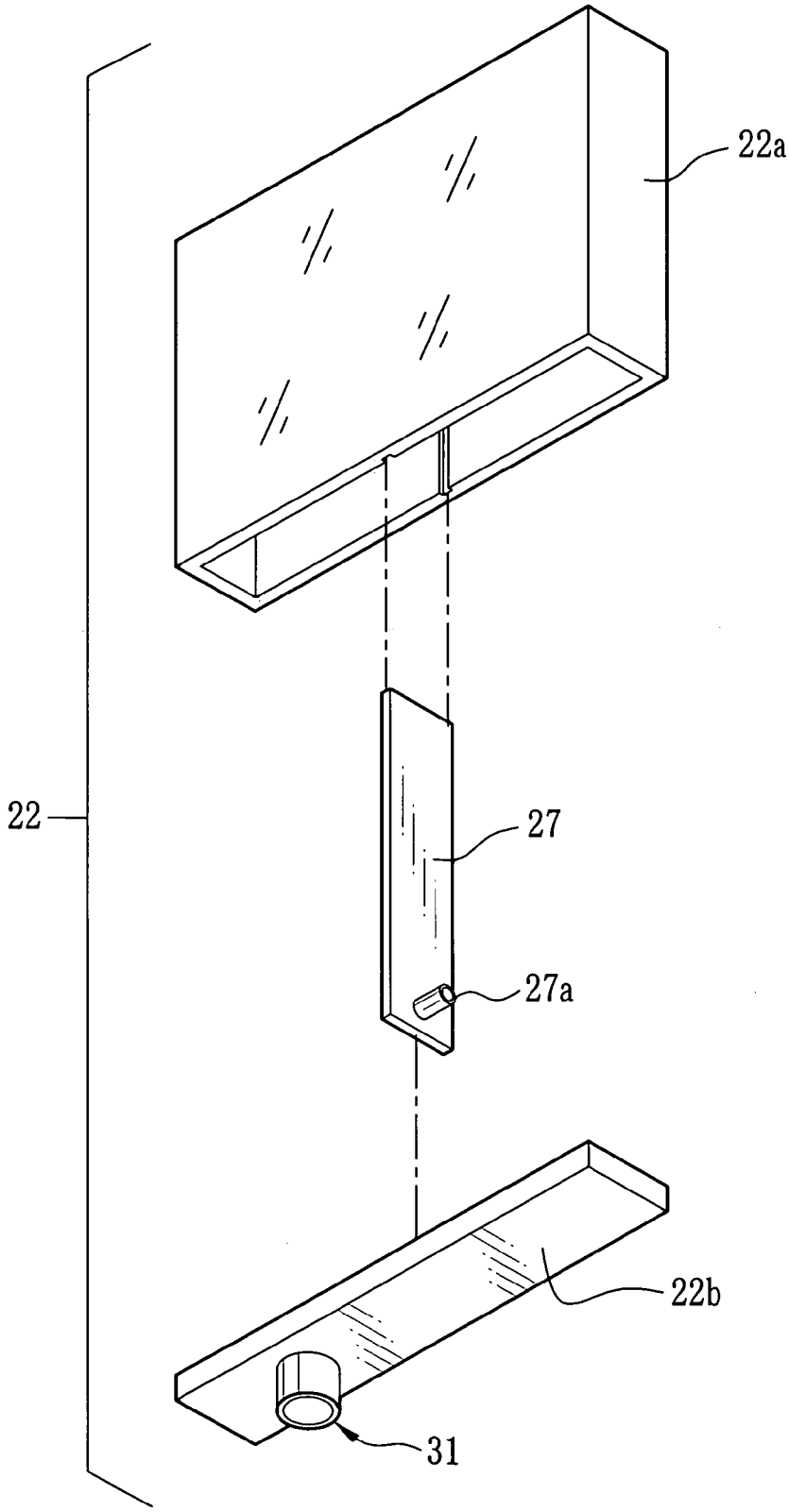
FIG. 3 is an exploded perspective view of a cartridge case of the ink cartridge.

As shown in FIG. 3, the case body 22 consists of a main body portion 22*a*, the partition wall 27, and a bottom lids 22*b* that is attached to close an open bottom of the main body portion 22*a*. Thus, the bottom lid 22*b* constitutes a bottom wall of the ink chambers 24. The partition wall 27 has an ink port 27*a* formed integrally at a lower near the bottom wall of the ink chambers 24. Through the ink port 27*a*, the ink is supplied from the storage chamber 25 to the negative pressure generating chamber 26. The ink port 27*a* is formed as a tube protruding into the storage chamber 25. The bottom lid 22*b* and the partition wall 27 are affixed to the main body portion 22*a* by welding.

An ejection opening 26*a* for ejecting the ink from the negative pressure generator chamber 26 out of the case body 22 is formed through a bottom portion of the negative pressure generator chamber 26. The ejection opening 26*a* and an ejection tube 29 extending downward from the ejection opening 26*a* constitute the ink outlet 31. In the ejection tube 29, a filter 33 for filtering the ink and a porous member 34 to insert the ink supply needle 36 are provided. The porous member 34 absorbs the ink past through the filter 33, to conducts the ink to the ink supply needle 36.

The negative pressure generator 28 is a spongy material having micro holes that generate the capillary force. Concretely, the negative pressure generator 28 is made of a porous material, including a foamed material like urethane foam, or a fibrous material like felt. The filter 33 is a spongy member that generates a capillary force like the negative pressure generator 28. A top surface of the filter 33 is in tight contact with a bottom surface of the negative pressure generator 28, and a bottom surface of the filter 33 is in tight contact with a top surface of the porous member 34. The filter 33 and the porous member 34 absorb the ink from the negative pressure generator 28 and hold the ink therein by their capillary force.

As the ink cartridge 20 is attached to the carriage 13, the negative pressure generator chamber 26 is connected to the recording head 12 that is placed under the carriage 13. More specifically, as the ink cartridge 20 is attached to the carriage 13, the ink supply needle 36 in the slot of the carriage 13 is stuck from the bottom into the porous member 34, providing the ink supply path from the ink chambers 24 through the ink supply needle 36 to the associated nozzles 12*a* of the recording head 12.

The negative pressure generator 28 generates a negative pressure due to its capillarity, which keeps the pressure of the ink in the negative pressure generator chamber 26 negative to the atmosphere. Keeping the ink pressure in the negative pressure generator chamber 26 negative to the atmosphere makes an ink pressure in the nozzles of the recording head 12 negative to the atmosphere, which forms meniscuses of the ink in the nozzles, preventing leakage of the ink from the nozzles.

For printing, the recording head 12 generates such a suction force against the negative pressure of the ink in the negative pressure generator chamber 26 that the ink is sucked from the negative pressure generator chamber 26 and is ejected from the outlets of the nozzles 12*a*. The ink contained in the negative pressure generator chamber 26 is thus consumed, and the ink contained in the storage chamber 25 is used for refilling the negative pressure generator chamber 26.

The storage chamber 25 holds an ink bag 37 containing the ink. The ink bag 37 consists of a bag body 38 made of an air-tight material, and an ink spout 39 provided at a lower position of the bag body 38. The ink spout 39 is fitted on the ink port 27*a*, to cover an open end of the ink port 27*a*. An outer periphery of the ink port 27*a* and an inner periphery of the ink spout 39 are bonded together by welding, so the ink bag 37 is fixed to the partition wall 27.

The ink bag 37 contains the ink air-tightly to isolate the ink from the atmosphere, so that the amount of air dissolved the ink is kept low in the ink bag 37. If the amount of air dissolved in the ink increases, air bubbles are generated in the ink, or the ink deteriorates due to chemical reaction on oxygen, causing malfunctions of the recording head 12. The ink bag 37 suppresses such troubles. As the ink bag 37 keeps the amount of air dissolved in the ink low, the ink is preserved in good condition, so the ink contained in the ink bag 37 may be preserved for a longer time, enabling the ink cartridge 20 to contain a larger volume of ink.

The bag body 38 is made of a flexible material, so it shrinks as the contained ink decreases. The bag body 38 has accordion folds 38*a* with substantially horizontal folding lines. Thanks to these accordion folds 38*a*, with the consumption of the ink contained in the ink bag 37, the ink bag 37 is folded along the accordion folds 82*a* to reduce its height while keeping its top surface approximately horizontal. Because the ink bag 37 will not irregularly shrink, the contained ink moves less with the shrinkage of the bag body 38, and the liquid surface of the ink inside the bag body 38 changes relatively continuously. Since the ink bag 37 is connected to the nozzles 12*a* through the ink port 27*a* and the negative pressure generator chamber 26, the weight of the ink in the ink bag 37 effects as a positive pressure on the nozzles 12*a*. The positive pressure applied to the nozzles 12*a* fluctuates less where the ink in the ink bag 37 moves less, and the liquid surface of the ink in the ink bag 37 changes continuously. As a result, fluctuation of internal pressure in the nozzles 12*a* is suppressed, so the stability of ink discharging operation of the recording head 12 is improved.

The top lid 23 is provided with first and second air introduction holes 41 and 47. The first air introduction hole 41 is located above the negative pressure generator chamber 26, to introduce the air into the negative pressure generator chamber 26 as the ink in the negative pressure generator chamber 26 decreases, whereas the second air introduction hole 47 is located above the storage chamber 25, to introduce the air into the storage chamber 25 as the ink in the storage chamber 25 decreases, The top lid 23 has a meander groove 42 formed in its top surface. One end 42*a* of the groove 42 is connected to the first air introduction hole 41, and a liquid sink 43 is formed on a path from the end 42*a* to a second end 42*b* of the groove 42. The groove 42 is covered from the top with a seal 45, exclusive of the second end 42*a*, so the second end 42*b* alone is exposed to the atmosphere. The groove 42 leads the ink to the liquid sink 43 if the ink leaks out of the negative pressure generator chamber 26 through the first air introduction hole 41. So the ink is prevented from leaking out of the ink cartridge 20. The air is introduced from the second end 42*b* into the first air introduction hole 41.

A number of ribs 46 are formed on the bottom side of the top lid 23 in an area facing to the negative pressure generator chamber 26. As the top lid 23 is attached to the case body 22, the ribs 46 protrude into the negative pressure generator chamber 26 and come into contact with a top side of the negative pressure generator 28, thereby pressing down the negative pressure generator 28 onto the bottom of the negative pressure generator chamber 26. Thereby, the negative pressure generator 28 is fixedly positioned to space the negative pressure generator 28 apart from the top lid 23, so the negative pressure generator 28 is prevented from being displaced to close the first air introduction hole 41.

Figure 4A:
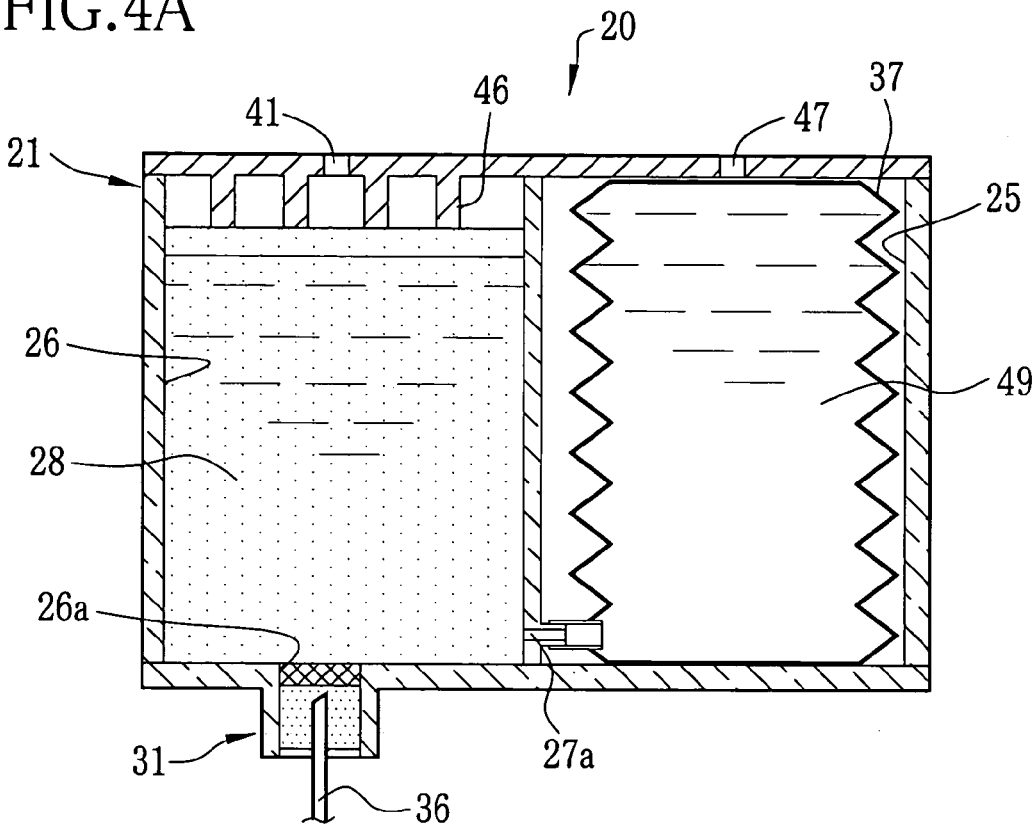
FIGS. 4A and 4B are sectional views of the ink cartridge.

Now the operation of the above embodiment will be described with reference to FIG. 4.

When the ink cartridge 20 is attached to the ink jet recording apparatus 10, the ink supply needle 36 is connected to the ink outlet 31, so the ink supply path from the ink cartridge 20 to the recording head 12 is established. As the ink cartridge 20 is provided with the negative pressure generator chamber 26, the internal pressure of the nozzles 12*a* is kept negative to the atmosphere, so the ink will not accidentally leak from the outlets of the nozzles 12*a*. Unlike the conventional ink cartridge, any suction pump is not necessary for generating the negative pressure, so that the ink cartridge 20 is simple in structure. Since the ink 49 is contained in the ink bag 37, the amount of air dissolved in the ink 49 is kept low, which contributes to ensuring stable discharging operation of the recording head 12.

Figure 4B:
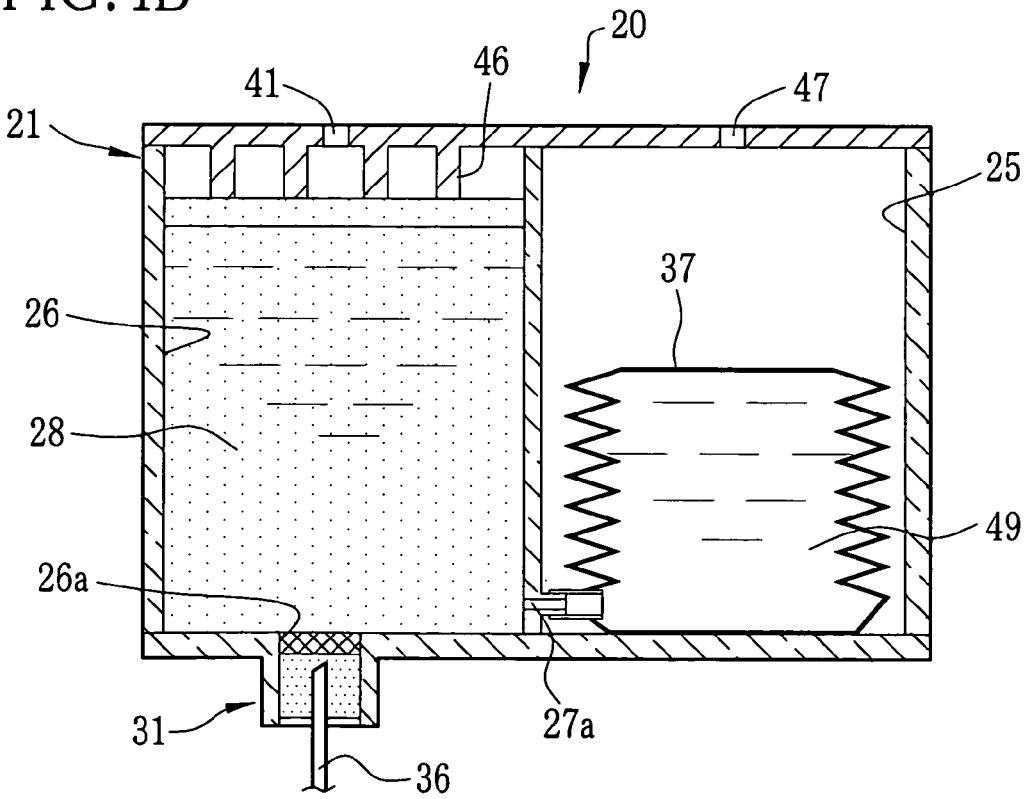

When the recording head 12 starts recording an image in response to a print command, the ink is supplied to the recording head 12 from the negative pressure generator chamber 26 through the ink supply needle 36. As a result, the pressure inside the negative pressure generator chamber 26 goes down, so the negative pressure generator chamber 26 introduce the air through the first air introduction hole 41, and at the same time, the ink 49 is supplied from the ink bag 37 to the negative pressure generator chamber 26 through the ink port 27*a*. The ink 49 is consumed in this way, and the residual amount of the ink 49 in the ink bag 37 reduces from the full level shown in FIG. 4A. With the ink 49 being consumed, the bag body 38 of the ink bag 37 shrinks as shown in FIG. 4B. As a result, the pressure inside the storage chamber 25 goes down, so the storage chamber 25 introduces the air through the second air introduction hole 47. As having the accordion folds, the ink bag 37 reduces its volume by reducing its height while keeping its horizontal contour. Therefore, the fluctuation in nozzle internal pressure with the reduction of the ink is suppressed.

Figure 5:
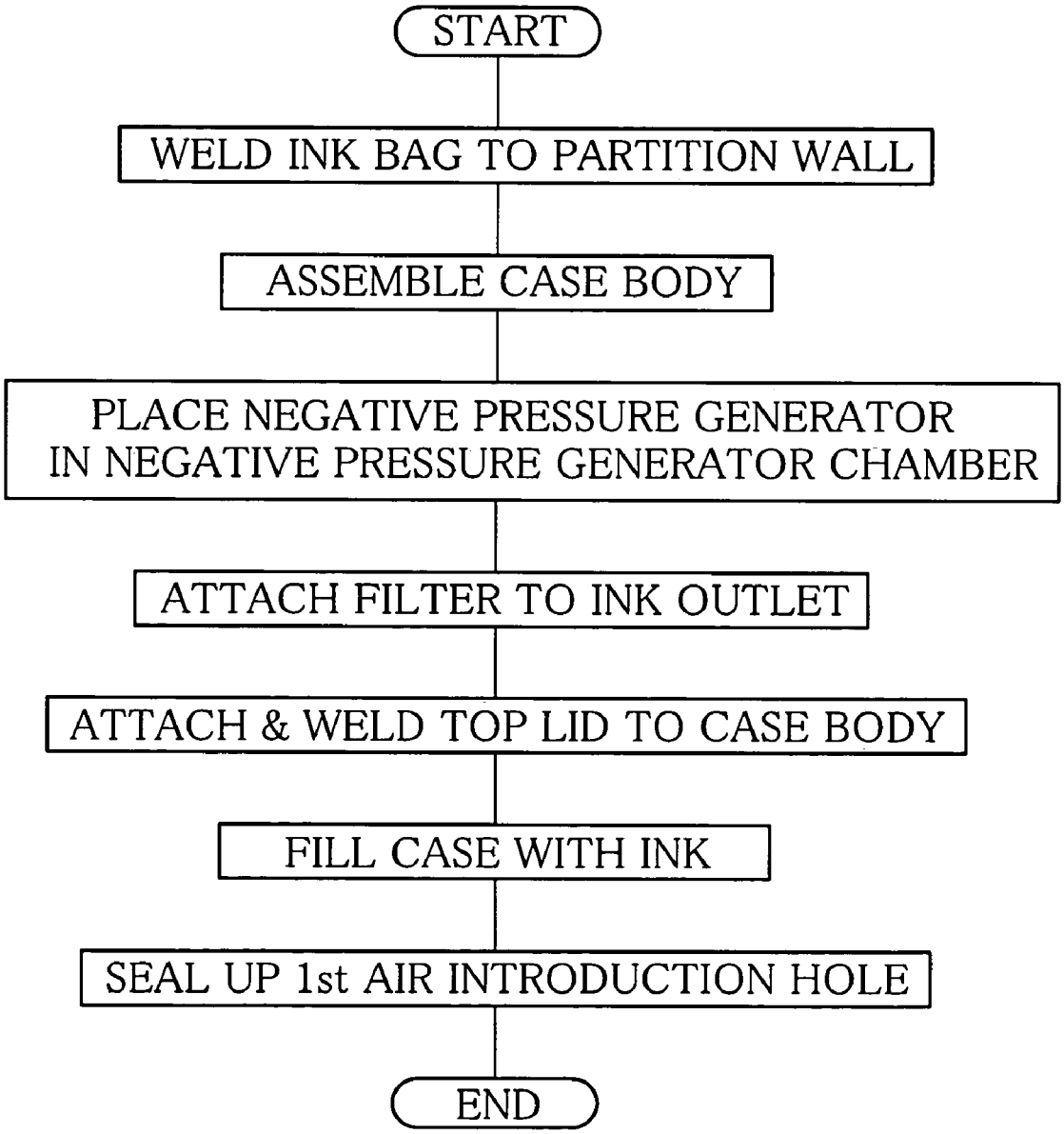
FIG. 5 is a flow chart illustrating a sequence of manufacturing the ink cartridge.

FIG. 5 illustrates the sequence of manufacturing the ink cartridge 20. First, the ink spout 38 of the ink bag 37 is joined to the ink port 27*a* of the partition wall 27, and the joint is fixed by welding. The partition wall 27 having the ink bag 37 attached thereto, and the bottom lid 22*b* are mounted and welded to the main body portion 22*a*, to assemble the case body 22. While assembling the case body 22, the filter 33 and the porous member 34 are mounted in the ink outlet 31. After the case body 22 is thus assembled, the negative pressure generator 28 is inserted from the open top into the negative pressure generator chamber 26. Thereafter, the top lid 23 is attached and welded to the case body 22, to assemble the case 21.

Thereafter, the ink is injected through the ink outlet 31 into the case 21, in a manner as set forth later. After the case 21 is fully filled with the ink, the seal 45 is stuck on the top surface of the top lid 23, to cover the first air introduction hole 41 and the groove 42 except the second end 42*b*. The second air introduction hole 47 may also be covered with a seal or the like. The ink cartridge 20 assembled in this way is shipped for sale. Before the ink cartridge 20 is attached to an ink jet recording apparatus, the seals or the like are removed to uncover the first and second air introduction holes 41 and 47.

Figure 6:
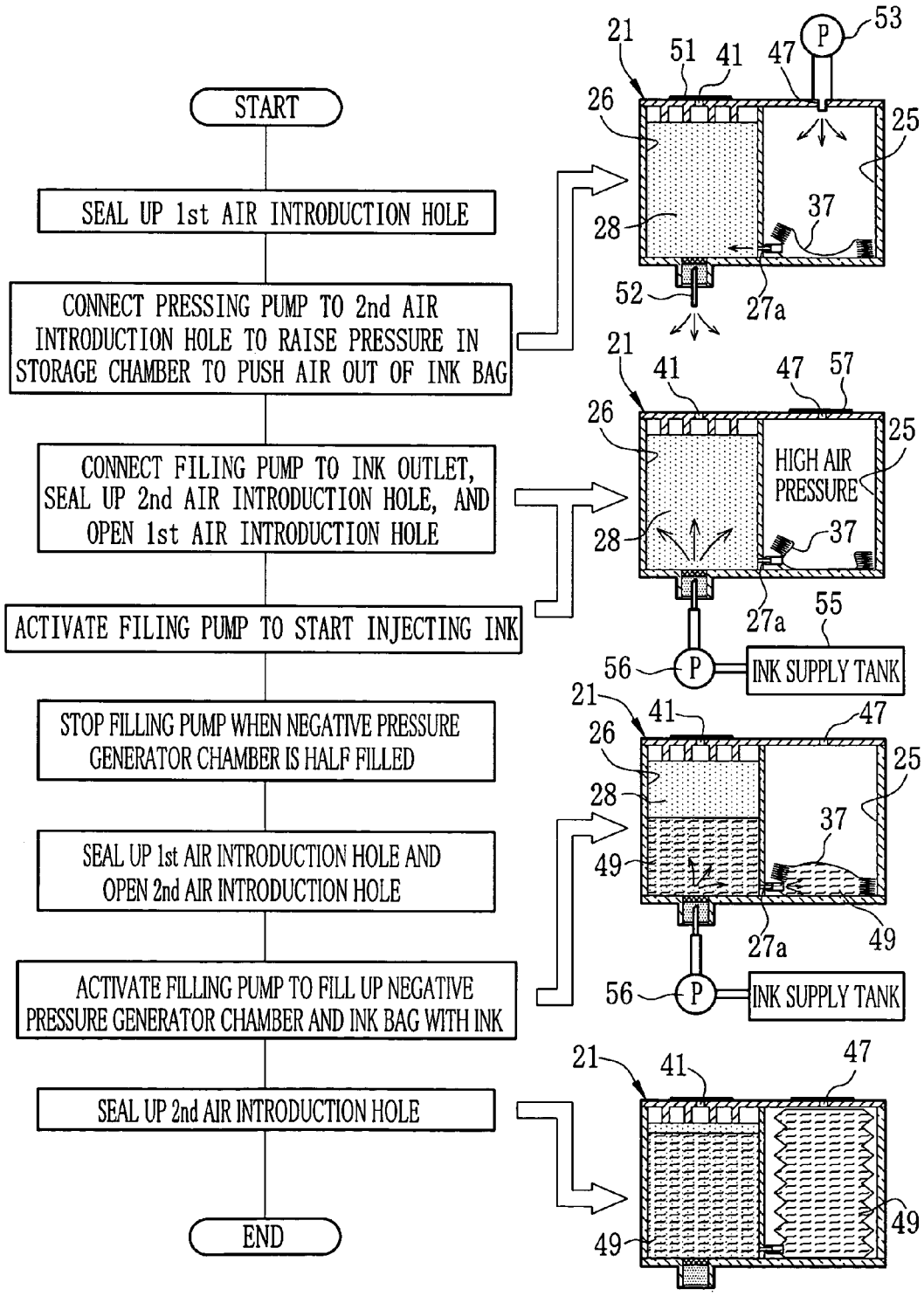
FIG. 6 is a flow chart illustrating a sequence of filling the ink cartridge with ink.

FIG. 6 shows the sequence of filling the case 21 with the ink. First, the air remaining in the ink bag 37 is ejected. For this purpose, the first air introduction hole 41 is closed with a seal 51 or another sealing member, and a hollow needle 52 is stuck into the ink outlet 31, to establish an air ejection duct. Then, a pressing pump 53 is connected to the second air introduction hole 47, to raise the pressure inside the storage chamber 25 up to a high level that is a number of times, e.g. twice or triple, the atmospheric pressure. The high pressure crushes the ink bag 37 down, to push the remaining air out of the ink bag 37 through the ink port 27*a*, the negative pressure generator chamber 26 and the hollow needle 52. If the case 21 is new, any ink does not remain in the ink bag 37. But if the case 21 is a reused or recycled one, the ink or other residues than the air can remain in the ink bag 37. In that case, such residues are pushed out together with the air through the ink outlet 31.

After the air is completely exhausted out of the ink bag 37, a filling pump 56, which is connected to an ink supply tank 55, is joined to the ink outlet 31 to inject the ink from the ink tank 55 into the case 21. As described above, the ink chambers 24 consist of the negative pressure generator chamber 26 and the storage chamber 25, and the negative pressure generator chamber 26 contains the negative pressure generator 28. In an initial stage where the negative pressure generator 28 does not absorb any ink at all, there is a greater flow resistance to the ink on penetrating the ink into the negative pressure generator 28 than a flow resistance through the ink port 27*a*, so the ink injected through the ink outlet 31 flows more easily through the ink port 27*a* into the ink bag 37. To hinder the ink from flowing into the ink bag 37, the second air introduction hole 47 is sealed up with a seal 57 or another sealing member to close the storage chamber 25 air-tightly while keeping the pressure inside the storage chamber 25 at the high level, when the ink begins to be injected through the ink outlet 31 into the negative pressure generator chamber 26. Instead, the first air introduction hole 41 is opened before the filling pump 56 is activated to start injecting the ink. Since the internal pressure of the storage chamber 25 is high, the ink injected by the filling pump 56 does not flow into the ink bag 37, but penetrates into the negative pressure generator 28 to fill the negative pressure generator chamber 26.

When the negative pressure generator chamber 26 is filled with the ink 49 up to a predetermined amount, e.g. about a half of the total volume of the negative pressure generator chamber 26, the filling pump 56 stops for a moment to seal up the first air introduction hole 41 again and open the second air introduction hole 47. Thereafter, the filling pump 56 is reactivated to restart injecting the ink. As the second air introduction hole 47 is opened, the pressure inside the storage chamber 25 is reduced, so the injected ink flows through the ink port 27*a* into the ink bag 37. Since the negative pressure generator 28 already absorbs the ink, the negative pressure generator 28 has a lower flow resistance to the ink than in the initial stage, so that the negative pressure generator 28 still absorbs the ink. In this way, the ink is injected till the negative pressure generator chamber 26 and the storage chamber 25 are filled up with the ink. Then, the filling pump 56 is removed, and the second air introduction hole 47 of the storage chamber 25 is sealed up again, completing the ink filling.

In the ink cartridge 20 of the first embodiment, the negative pressure generator chamber 26 and the storage chamber 25 are always interconnected to each other, so the ink can flow from the storage chamber 25 into the negative pressure generator chamber 26 at any time. In order to keep the nozzle internal pressure negative to the atmosphere, a positive pressure due to the ink weight in the storage chamber 25 must be kept lower than a negative pressure generated by the negative pressure generator 28. To keep such a relationship, certain restrictions are imposed on the ink capacity of the negative pressure generator chamber 26 and that of the storage chamber 25.

Figure 7:
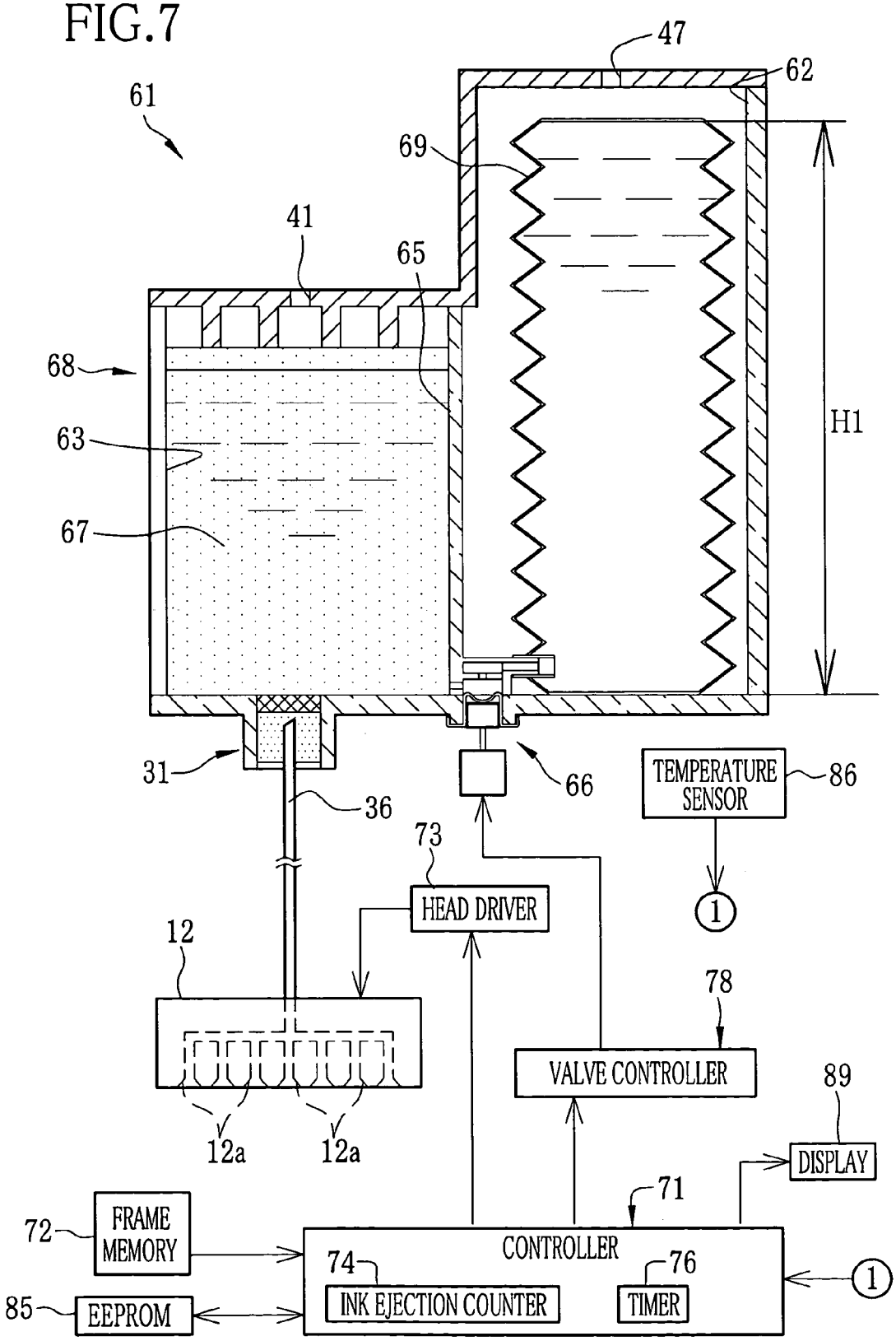
FIG. 7 is an explanatory diagram illustrating an ink cartridge having a valve mechanism for opening or closing an ink port from an ink bag to a negative pressure generator chamber, and an ink jet recording apparatus having a valve controller for controlling the valve mechanism.

In an ink cartridge 61 shown in FIG. 7, a valve mechanism 66 is disposed in an ink port 64 that connects a storage chamber 62 to a negative pressure generator chamber 63 that is parted by a partition wall 65 from the storage chamber 62. The valve mechanism 66 is an ink port opening closing mechanism, and is switched over between a closed position to close the ink port 64, and an open position to open the ink port 64. In the opening position of the valve mechanism 66, the ink 49 can flow from an ink bag 69 of the storage chamber 62 to the negative pressure generator chamber 63. The valve mechanism 66 prevents continual affection of the positive pressure, which is caused by the ink weight in the storage chamber 62, onto the nozzles 12*a*. Thus, the ink capacity of the storage chamber 62 and that of the negative pressure generator chamber 63 of the ink cartridge 61 are released from such restriction as imposed on the first embodiment. Accordingly, it becomes possible to make the ink capacity of the storage chamber 62 greater than that of the negative pressure generator chamber 63.

Because the negative pressure generator chamber 63 contains a negative pressure generator 67, the ink capacity of the negative pressure generator chamber 63 is reduced correspondingly. Therefore, the ratio of the ink capacity to the volume of the negative pressure generator chamber 63 is lower than the ratio of the ink capacity to the volume of the storage chamber 62. Thanks to the valve mechanism 66, the storage chamber 62 may be made larger than the negative pressure generator chamber 63. For example, as shown in FIG. 7, the storage chamber 62 may be higher than the negative pressure generator chamber 63. Then, the total ink capacity and thus the ratio of the total ink capacity to the total volume of a case 68 of the ink cartridge 61 is improved.

As the valve mechanism 66 disconnects the negative pressure generator chamber 63 from the storage chamber 62, the nozzle internal pressure depends on the volume of the ink contained in the negative pressure generator chamber 63. In view of this fact, the amount of ink supplied from the ink bag 69 of the storage chamber 62 is controlled according to the consumed amount of ink, such that the ink volume in the negative pressure generator chamber 63 would not largely vary. Thereby, fluctuation of the nozzle internal pressure is suppressed.

A controller 71 totally controls components of an ink jet recording apparatus 10. The controller 71 controls a head driver 73 in accordance with image data read out from a frame memory 72. The head driver 73 drives a recording head 12 to eject the ink through nozzles 12*a* in accordance with the image data. The controller 71 is provided with an ink ejection counter 74 to count the number of ejections through each of the nozzles 12*a*. The nozzles 12*a* are determined to eject a constant amount of ink at a time, so that the total amount of ink ejected from the recording head 12 may be calculated from the count of the ink ejection counter 74. The controller 71 calculates the ejected ink amount at regular time intervals, while measuring the time by a timer 76.

Instead of detecting the ejected ink amount based on the number of ink ejections, the controller 71 can detect the ejected ink amount by estimation based on the image data.

A valve controller 78 controls the valve mechanism 66. The valve controller 78 calculates an amount of ink to supply to the negative pressure generator chamber 63 in accordance with the ejected ink amount as detected by the controller 71, and controls the time to open and close the valve mechanism 66 so as to supply the ink from the ink bag 69 to the negative pressure generator chamber 63 by the calculated amount.

Figure 8:
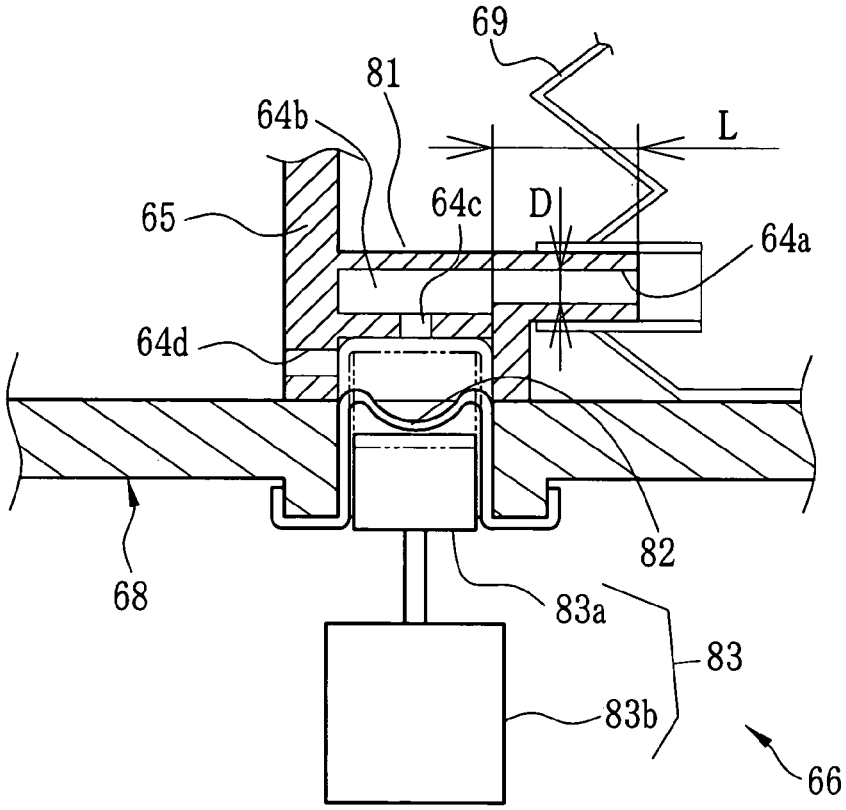
FIG. 8 is an explanatory sectional diagram illustrating the valve mechanism mounted in an ink port section.
Figure 9:
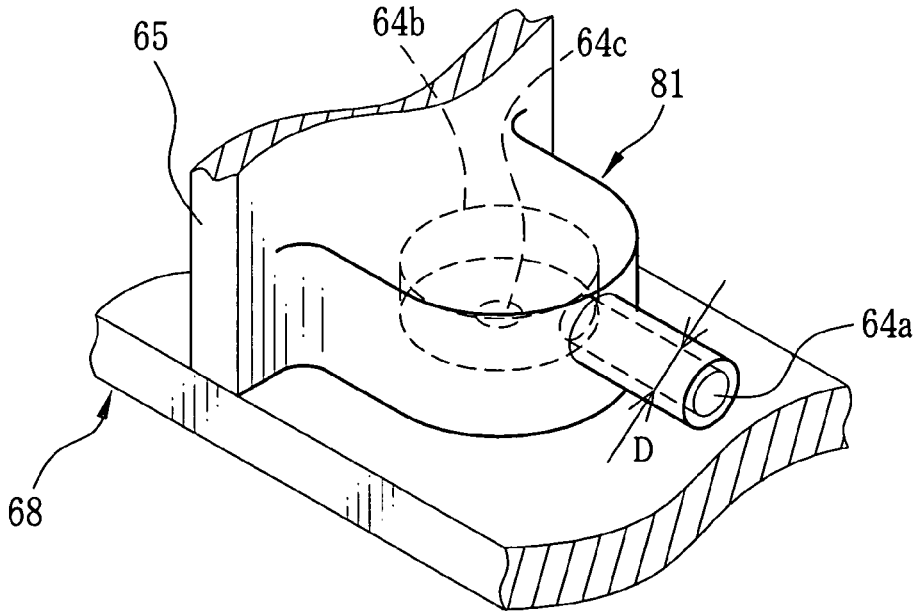
FIG. 9 is a fragmentary perspective view of the ink port section.

As shown in FIGS. 8 and 9, the valve mechanism 66 consists of an ink port block 81 having the ink port 64 formed through it, a valve 82 disposed in the ink port 64, and an actuator 83 for driving the valve 82 to open or close the ink port 64. The ink port 64 consists of a tubular introduction channel 64*a* that is joined to the ink bag 69, a round chamber 64*b*, a first opening 64*c* formed through a bottom of the round chamber 64*b*, and a second opening 64*d* formed through the partition wall 65. The first opening 64*c* extends vertically, whereas the second opening 64*d* extends horizontally. An opening is formed through a bottom wall of the case 68 at a position corresponding to the first and second openings 64*c* and 64*d*, and the valve 82 is mounted to bung up the opening of the bottom wall.

The valve 82 is an elastic film made of rubber or the like, and opens the first and second openings 64*c* and 64*d* in its opening position, as shown by solid lines in FIG. 8, allowing the ink to flow from the first opening 64*c* to the second opening 64*d*. When a pushing member 83*c* of the actuator 83 pushes up the valve 82, the valve 82 is elastically deformed to move to its closing position, as shown by phantom lines in FIG. 8. In the closing position, the valve 82 closes the first and second openings 64*c* and 64*d*, thereby to stop the ink flow from the first opening 64*c* to the second opening 64*d*. Thus, the valve 82 opens or closes the ink port 64. For example, the actuator 83 contains a solenoid, which is not shown but consists of a coil and an iron core, in a housing 83*b*, so that the actuator 83 drives the valve 82 when the solenoid is powered.

Figure 10:
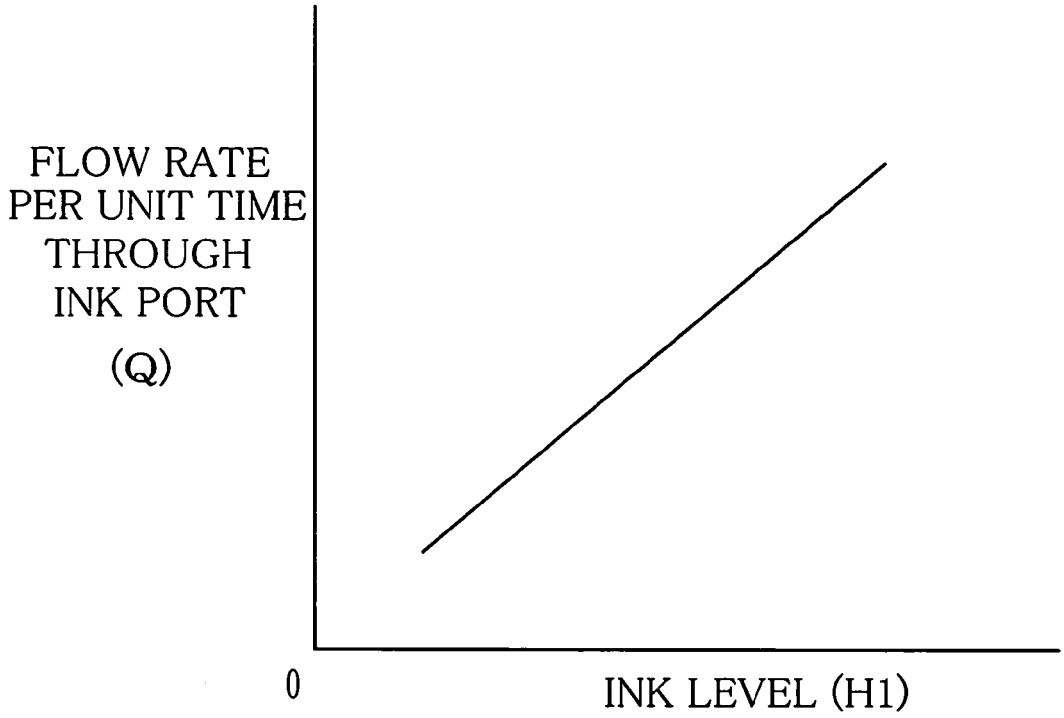
FIG. 10 is a graph illustrating a relationship between flow rate of the ink through the ink port and ink level in the ink bag.
Figure 11:
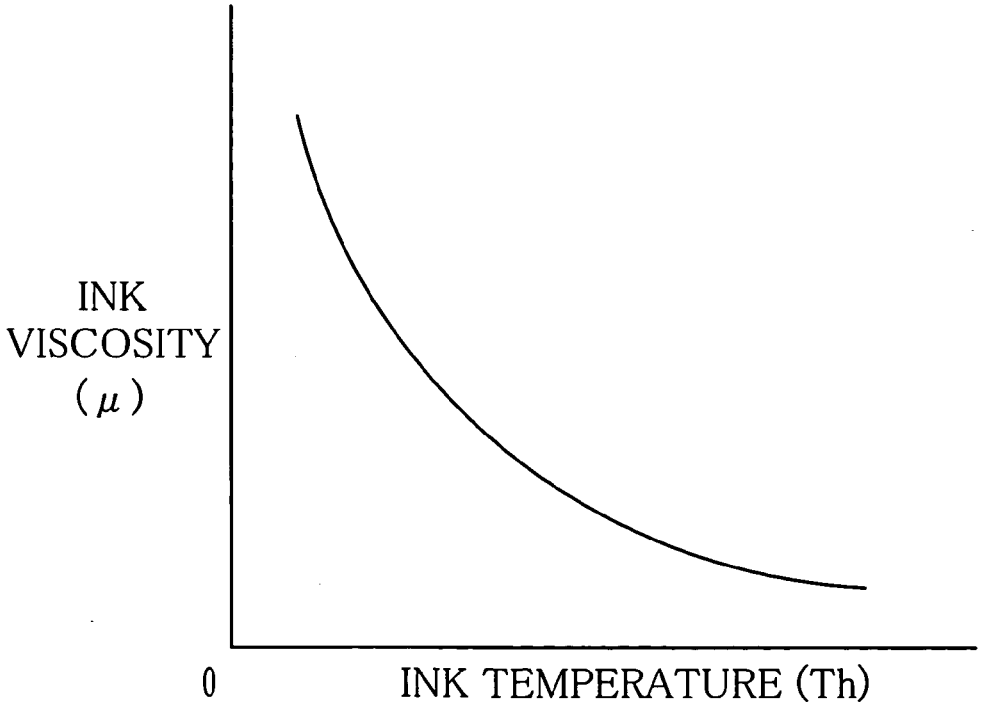
FIG. 11 is a graph illustrating a relationship between the ink viscosity and the temperature.

The ink 49 flows through the ink port 64 at a flow rate Q, i.e. a volume per unit time of the flown ink, which is dependent upon a length L and an internal diameter D of the introduction channel 64*a* that provides the maximum flow resistance. Besides that, as shown in FIG. 10, the flow rate Q is proportional to the ink level H1 in the ink bag 69. Consequently, the flow rate Q may be calculated according to the following formula:

$$Q=\rho\times g\times H1\times(\pi\times D^4)/(128\times\mu\times L)$$

wherein ρ represents an ink density, μ represents an ink viscosity, and g represents an acceleration due to gravity.

As seen from the formula (1), the flow rate Q decreases as the ink level H1 gets lower. Accordingly, time for opening the valve 82 to supply the same amount of ink through the ink port 64 gets longer as the ink level H1 gets lower. It is found by experiments that, assuming the ink viscosity μ is constant, the ink pressure is about 4.5 times greater at the surface height H1 of 50 mm than at the surface height H1 of 11 mm. Therefore, when the surface height H1 is 50 mm, the valve opening time for supplying the same amount of ink is about one-fourth the valve opening time required when the surface height H1 is 11 mm.

The controller 71 is connected to a non-volatile memory, e.g. EEPROM 85. The EEPROM 85 memorizes the ink level H1. During the manufacture, the EEPROM 85 memorizes a maximum value of the ink level H1 where the ink bag 69 is filled up with the ink. The memorized ink level H1 is revised with the consumption of the ink. When the ink level H1 gets lower than a predetermined value, the controller 71 judges that the ink cartridge 61 is running out of the ink 49, and displays a warning on a display device 89, to notice the user of the ink run-out. The valve controller 78 reads the ink level H1 through the controller 71 from the EEPROM 85.

The valve controller 78 calculates the flow rate Q based on the above formula (1), and calculates a time for opening the valve 82 in accordance with an ejected amount of the ink 49. Instead of calculating the flow rate Q based on the above formula, it is possible to determine the flow rate Q with reference to a lookup table stored in a memory.

Meanwhile, the ink viscosity μ is inverse-proportional to the ink temperature Th, so the ink viscosity μ gets higher as the ink temperature Th gets lower. According to experiments, when the ink temperature Th falls from 35 C to 15 C, the ink viscosity μ approximately doubles. As a result, the flow rate Q is reduced by half, so the time for opening the valve 82 to supply the same amount of ink approximately doubles. In view of this, the ink jet recording apparatus 10 is provided with a temperature sensor 86 to measure the ink temperature in the ink cartridge 61. The temperature sensor 86 may be mounted on a carriage for the recording head 12. The valve controller 78 reads through the controller 71 the ink temperature as measured by the temperature sensor 86, to calculate the ink viscosity μ.

Figure 12:
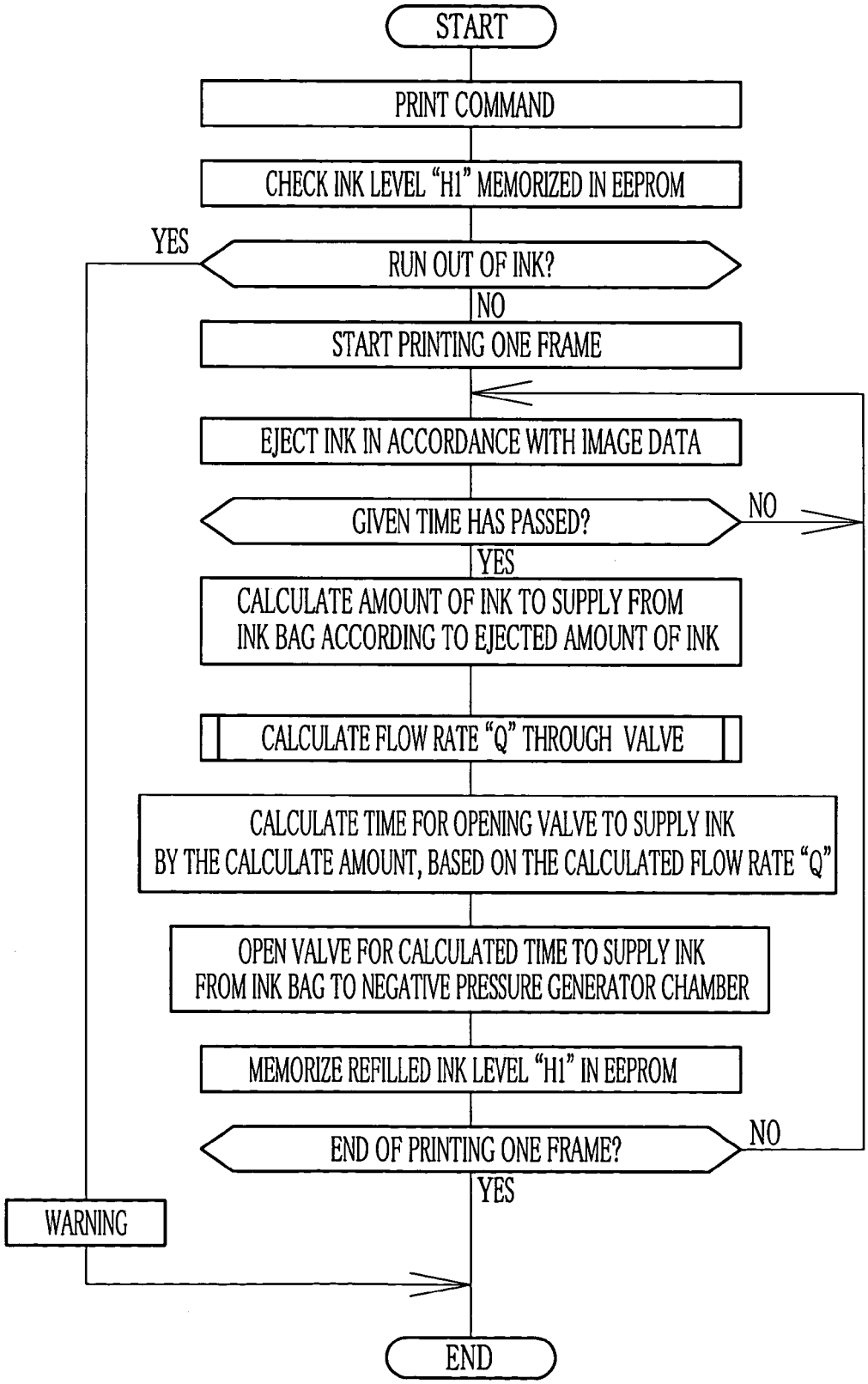
FIG. 12 is a flow chart illustrating a printing sequence of the ink jet recording apparatus of FIG. 7.
Figure 13:
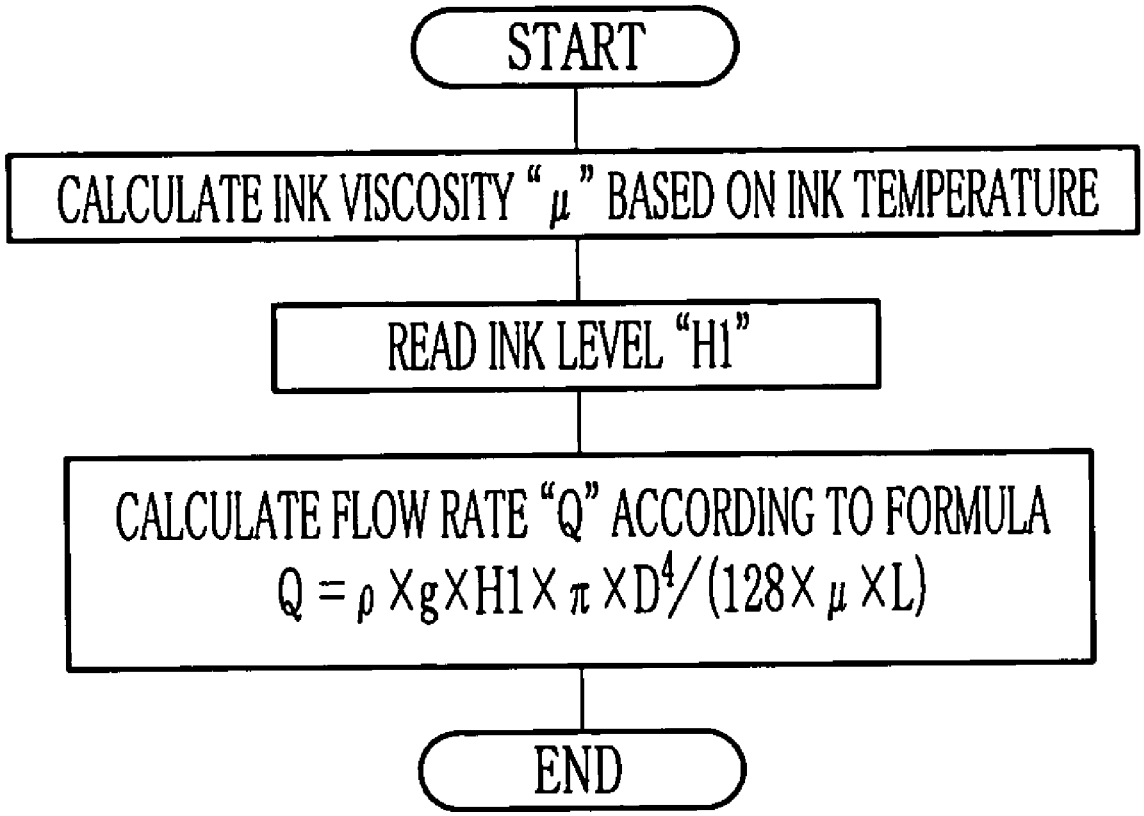
FIG. 13 is a flow chart illustrating a sequence of calculating the flow rate of the ink through the ink port.

Now the printing operation of the embodiment shown in FIG. 7 will be described with reference to FIGS. 12 and 13. When a print command is entered, the controller 71 reads the ink level H1 from the EEPROM 85. If the ink level H1 is less than the predetermined level, the controller 71 judges that the ink cartridge 61 is running out of the ink, and gives the warning through the display device 78. If not, the controller 71 stars printing a frame of image. The recording head 12 is driven based on the image data, to eject the ink. At the start of printing, the ink port 64 is closed, so the ink ejection is done stably regardless of the residual amount of the ink in the ink bag 69.

A given time after the start of discharging the ink, the controller 71 commands the valve controller 78 to start supplying the ink from the ink bag 69 to the negative pressure generator chamber 63 in accordance with the ejected amount of the ink. Then, the valve controller 78 calculates the flow rate Q of the ink through the ink port 64. As shown in FIG. 13, the valve controller 78 calculates the ink viscosity μ based on the ink temperature Th measured by the temperature sensor 86, and reads the ink level H1, to calculate the flow rate Q according to the above formula (1).

Based on the flow rate Q, the valve controller 78 calculates a valve opening time necessary for supplying the ink by the amount calculated by the controller 71, i.e. the ejected amount of the ink. Then the actuator 83 switches the valve 82 to the open position, so the ink flows from the ink bag 69 to the negative pressure generator chamber 63. Since the valve 82 is opened for the calculated valve opening time, the ink is supplied to the negative pressure generator chamber 63 by the amount corresponding to the amount ejected from the negative pressure generator chamber 63. Consequently, variations in the ink volume in the negative pressure generator chamber 63 is suppressed, so is the nozzle internal pressure. Therefore, the stability of ink discharging operation is improved.

As the ink is supplied from the ink bag 69 to the negative pressure generator chamber 63, the ink level H1 in the ink bag 69 comes down. Then the controller 71 revises the value memorized as the ink level H1 in the EEPROM 78. The sequence as above is cyclically executed till the printing of one frame is finished.

Although the valve 82 of the valve mechanism 66 is mounted in the ink cartridge 61, and the actuator 83 is mounted in the ink jet recording apparatus in the above embodiment, it is possible to mount an actuator in the ink cartridge.

Figure 14:
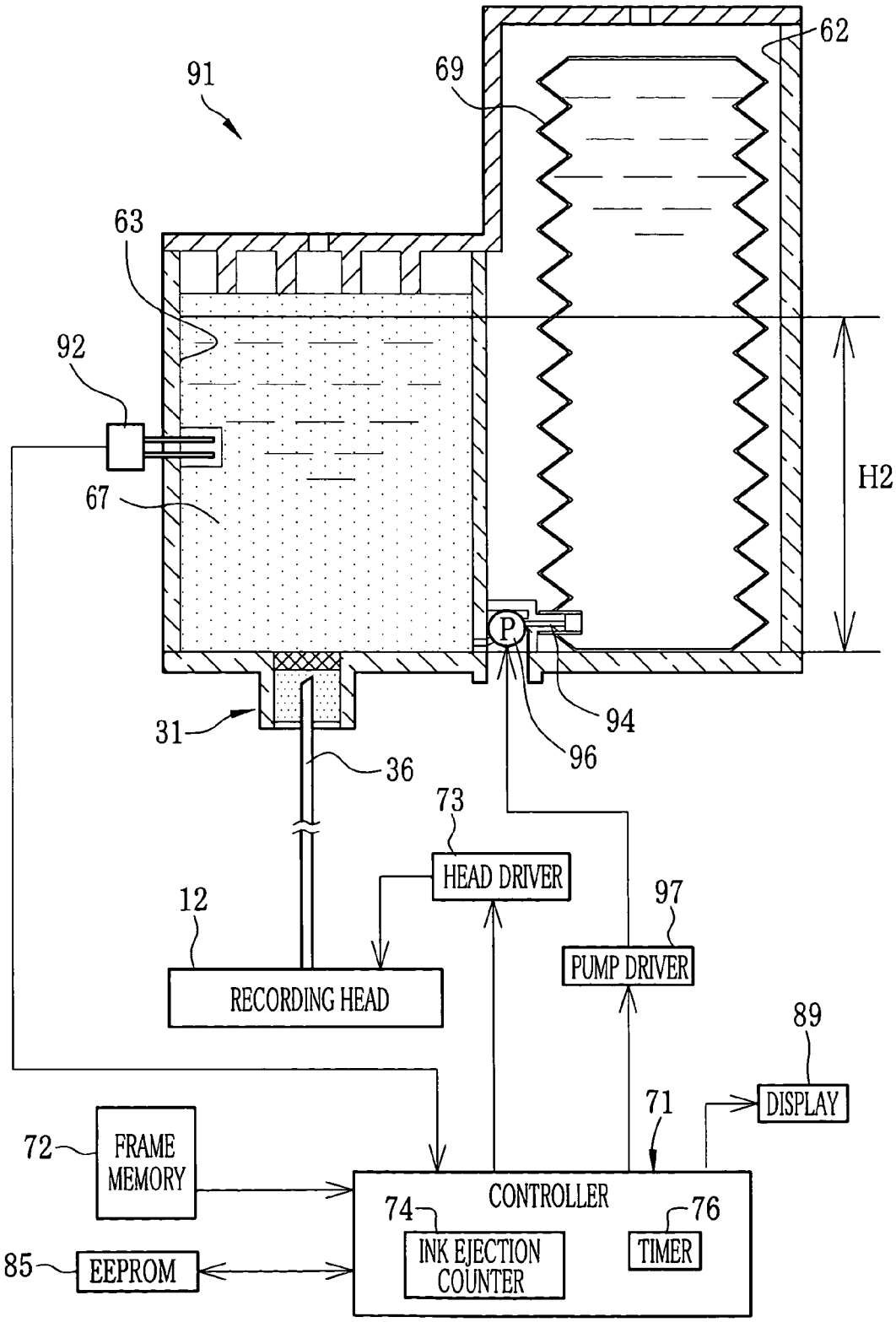
FIG. 14 is an explanatory diagram illustrating an ink cartridge having an ink level sensor, and an ink jet recording apparatus that controls an ink port opening closing mechanism in cooperation with the ink level sensor.

An ink cartridge 91 shown in FIG. 14 is provided with a surface level sensor 92 for detecting if an ink level H2 in a negative pressure generator chamber 63 is lower than a predetermined reference level. So an ink jet recording apparatus can supply the ink from an ink bag 69 to the negative pressure generator chamber 63 when it detects through the surface level sensor 92 that the ink level H2 gets lower than the reference level. Thus, the ink volume in the negative pressure generator chamber 63 is kept around a certain level, so the nozzle internal pressure varies less, ensuring the stability of ink discharging operation. In the illustrated embodiment, the surface level sensor 92 consists of a pair of conductive metal strips that protrude into the negative pressure generator chamber 63. The metal strips are arranged vertically to each other. While the ink level H2 in the negative pressure generator chamber 63 is above the metal strips, the metal strips are electrically connected through the ink. When the ink level H2 goes below the upper metal strip, the metal strips are electrically disconnected from each other. Thereby, a controller 71 of the ink jet recording apparatus detects that the ink level H2 gets lower than the reference level.

As an ink port opening closing mechanism for an ink port 94 between the ink bag 69 and the negative pressure generator chamber 63 of the ink cartridge 91, a suction pump 96 is used in place of the valve mechanism. The suction pump 96 can suck the ink from the ink bag 69 and send it to the negative pressure generator chamber 63, so the ink left unused in the ink bag 69 is reduced in comparison with the case using the valve mechanism.

The controller 71 controls the suction pump 96 through a pump driver 97. While the suction pump 96 is activated, the ink port 94 is set in an open position. When the suction pump 96 is deactivated, the ink port 94 is closed. That is, the opening time of the ink port 94 is decided by the operating time of the suction pump 96. The suction pump 96 may be mounted in a case of the ink cartridge 91, or in the ink jet recording apparatus. The suction pump 96 is preferably a micro pump, especially where it is mounted to the ink cartridge 91.

Figure 15:
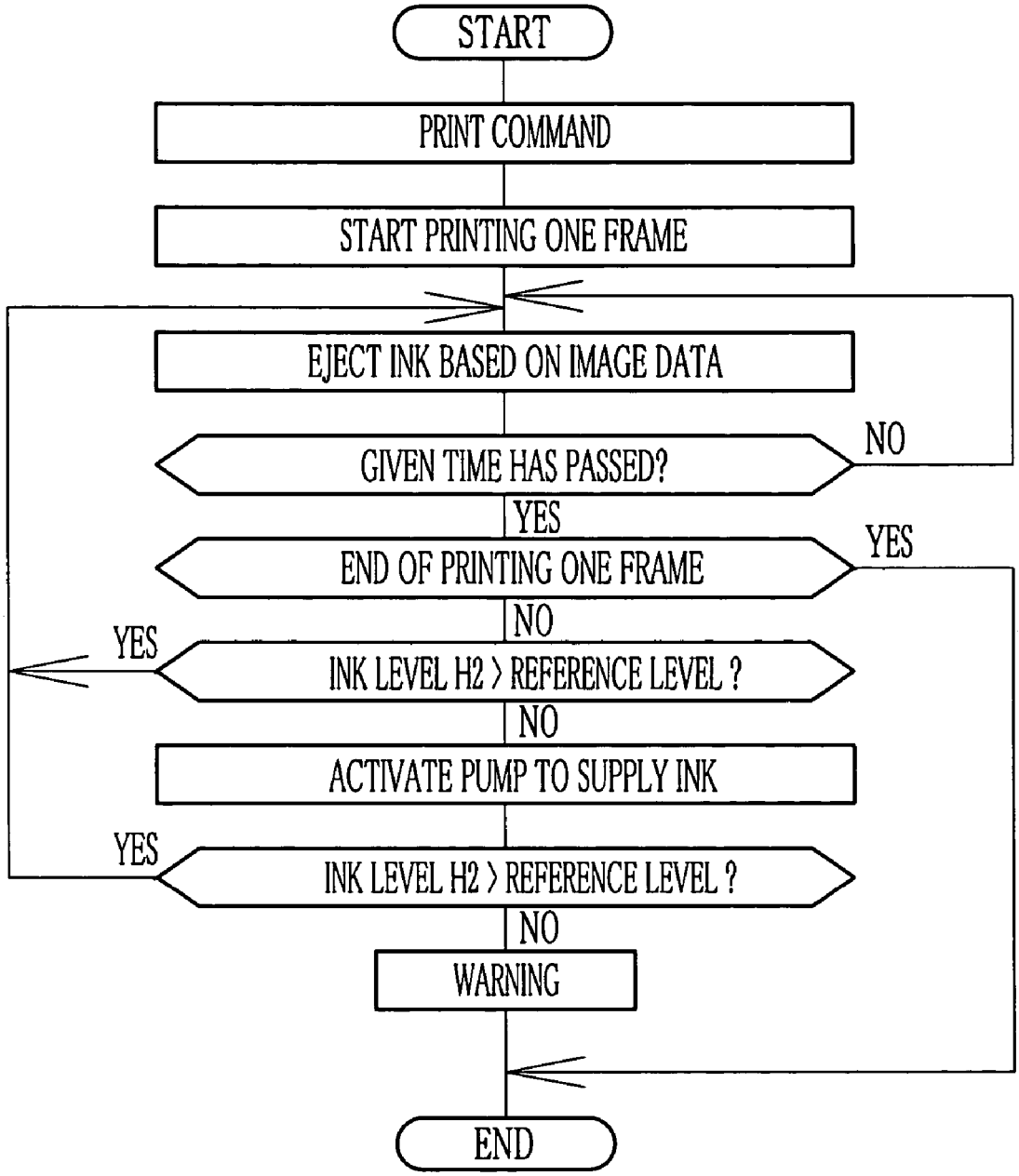
FIG. 15 is a flow chart illustrating a printing sequence of the ink jet recording apparatus of FIG. 14.

As shown in FIG. 15, when a print command is entered, the ink jet recording apparatus starts printing a frame of image. A recording head 12 ejects the ink in accordance with image data. A timer 76 measures the time from the start of printing. Each time a given time has passed, the controller 71 makes a decision as to whether the suction pump 96 is to be activated to refill the negative pressure generator chamber 63 with the ink in accordance with the ejected amount of the ink. For this purpose, the controller 71 checks the ink level H2 through the surface level sensor 92. If the ink level H2 is higher than the reference level, the controller 71 continues printing without executing the ink refill. On the contrary, if the ink level H2 is lower than the reference level, the controller 71 drives the suction pump 96 through the pump driver 97 to refill the negative pressure generator chamber 63 with the ink. The amount of the ink to be supplied is calculated on the basis of the ejected amount of the ink as measured during the given time. For example, about five times the ejected amount of the ink is supplied.

After the negative pressure generator chamber 63 is thus refilled, the ink level H2 is checked again. If it is confirmed that the ink level H2 is above the reference level, the printing is continued. In this way, the image of one frame is printed. If the ink level H2 is still below the reference level even after the ink refill, the ink is supplied again from the ink bag 69 to the negative pressure generator chamber 63. If the ink level H2 does not go above the reference level even after a number of times of ink supplying operation, the controller 71 regards that there is little or no ink left in the ink bag 69, and gives a corresponding warning on a display device 78.

The ink cartridges 61 and 91 of the second and third embodiment may be assembled fundamentally in the same sequence as the ink cartridge 21 of the first embodiment, but appropriately including additional steps for mounting the valve, the suction pump or the surface level sensor.

Concerting the ink filling process for the ink cartridge having the ink port opening closing mechanism, like the valve or the suction pump, the ink port opening closing mechanism opens the ink port while the remaining air is being exhausted from the ink bag through the ink port, as well as while the ink is being fed into the ink bag through the in port. On injecting the ink into the negative pressure generator chamber before feeding the ink into the ink bag, the ink port is closed.

Although the present invention has been described with respect to the embodiment wherein the inks of different colors are supplied from the ink cartridges that are removably connected to the recording head, the present invention is applicable to an ink jet recording apparatus using a single ink cartridge for supplying ink of one color. The present invention is also applicable to an ink cartridge where a recording head is integrated with an ink container, or an ink container fixedly mounted in an ink jet recording apparatus.

Thus the present invention is not to be limited to the above-described embodiments, but various modifications will be possible without departing from the scope of claims as appended hereto.

What is claimed is:

1. An ink container case containing ink having a case bottom portion with an ink outlet formed therein, wherein the ink is supplied to an ink jet type recording head with a number of nozzles from said ink container case through said ink outlet in the case bottom portion while said ink container case is connected as a unitary body through the ink outlet to said ink jet type recording head and the ink thus supplied to the ink jet type recording head is ejected through said nozzles to perform ink jet recording, said ink container case being further removable as the unitary body from the ink jet type recording head and comprising:

a negative pressure generator chamber portion that has a negative pressure generator chamber bottom portion that forms a part of the case bottom portion that includes said ink outlet, the ink container case negative pressure generator portion holding a negative pressure generator that absorbs and holds the ink received from the ink outlet by capillary force, and keeps pressure inside said nozzles negative to atmospheric pressure while said ink outlet is connected to said recording head;

a storage chamber portion that is separated from said negative pressure generator chamber portion by a partition wall and that has a storage chamber bottom portion that forms a part of the case bottom, the storage chamber holding an air-tight ink bag storing the ink;

an ink port formed through said partition wall and joined to an ink spout of said ink bag to connect said ink bag to said negative pressure generator chamber;

a first air introduction hole for introducing air into said negative pressure generator chamber as the ink in said negative pressure generator chamber decreases; and a second air introduction hole for introducing air into said storage chamber as the ink in said ink bag decreases, wherein said ink bag has accordion folds even in the state when the ink bag is completely filled with ink, said accordion folds each extending substantially horizontally, so that said ink bag is folded down along said accordion folds while keeping a top surface thereof substantially horizontal as the ink in said ink bag decreases from the completely filled state to a less than completely filled state and the air is introduced into said storage chamber through said second air introduction hole.

2. The ink container case as claimed in claim 1, wherein said ink container case removable as a unitary body from the ink jet type recording head further comprises a top lid for closing an open top of said ink container case, wherein the top lid further forms a continuous top surface over the negative pressure generator chamber portion, storage chamber portion, and the partition wall and said first and second air introduction holes are formed through said continuous top surface of said top lid.

3. The ink container case as claimed in claim 1, wherein said ink port may be switched over between an opening position to permit the ink flowing through said ink port, and a closing position to stop the ink from flowing through said ink port.

4. The ink container case as claimed in claim 3, wherein said ink port is switched over between said opening position and said closing position by an ink port opening closing mechanism.

5. The ink container case as claimed in claim 4, wherein said ink port opening closing mechanism comprises a valve for opening and closing said ink port, and an actuator for driving said valve, wherein at least said valve is mounted in said case.

6. The ink container case as claimed in claim 5, wherein said valve is made of an elastic film and is brought into said closing position when said actuator drives a pushing member to push said valve.

7. The ink container case as claimed in claim 4, wherein said ink port opening closing mechanism comprises a pump for sucking the ink from said ink bag and sending the ink to said negative pressure generator chamber.

8. The ink container case as claimed in claim 7, wherein said pump is a micro pump mounted in said case.

9. The ink container case as claimed in claim 1, wherein said ink outlet is provided with a filter for filtering the ink as it is fed out from said ink container.

10. The ink container case as claimed in claim 1, wherein said ink outlet is provided with a porous member, into which a hollow needle is stuck to constitute an ink supply path to said nozzles.

11. The ink container case as claimed in claim 1, wherein said ink container case bottom portion is in direct engagement with side walls that that extend upwardly to form exterior parts of the negative pressure generator chamber portion and the storage chamber portion, with all of the sidewalls extending upwardly to a same extent.

12. An ink jet recording apparatus comprising:

an ink jet type recording head discharging ink through nozzles in accordance with image data to print an image;

an ink container for supplying said recording head with the ink, said ink container being disposed above said recording head, and comprising a negative pressure generator chamber containing a negative pressure generator that absorbs and holds the ink by its capillary force to keep pressure inside said nozzles negative to atmospheric pressure, a storage chamber storing the ink to be supplied to said negative pressure generator chamber, and an ink port for supplying the ink from said storage chamber to said negative pressure generator chamber;

an ink port opening closing mechanism for switching over said ink port between an opening position to permit the ink flowing through said ink port, and a closing position to stop the ink from flowing through said ink port; and a control device for controlling said ink port opening closing mechanism, wherein the storage chamber holds an ink bag storing the ink and said ink bag has accordion folds even in the state when the ink bag is completely filled with ink, said accordion folds each extending substantially horizontally, so that said ink bag is folded down along said accordion folds while keeping a top surface thereof substantially horizontal as the ink in said ink bag decreases and the air is introduced into said storage chamber through said second air introduction hole.

13. The ink jet recording apparatus as claimed in claim 12, wherein said ink container is formed as a unitary body that is connected to said recording head and that is readably disconnected from said recording head, which recording head is fixedly mounted in said ink jet recording apparatus.

14. The ink jet recording apparatus as claimed in claim 12, wherein said ink port opening closing mechanism comprises a valve for opening and closing said ink port, and an actuator for driving said valve.

15. The ink jet recording apparatus as claimed in claim 12, wherein said ink port opening closing mechanism comprises a micro pump for sucking the ink from said storage chamber and sending the ink to said negative pressure generator chamber.

16. The ink jet recording apparatus as claimed in claim 12, further comprising an ejected ink amount detecting device for detecting an ejected amount of ink from said recording head, wherein said control device controls said ink port opening closing mechanism to supply the ink to said negative pressure generator chamber by an amount according to the ejected amount of the ink.

17. The ink jet recording apparatus as claimed in claim 16, wherein said ejected ink amount detecting device detects the ejected amount of the ink by counting the number of ink ejections from said recording head.

18. The ink jet recording apparatus as claimed in claim 16, wherein said ejected ink amount detecting device detects the ejected amount of the ink by estimation based on the image data.

19. The ink jet recording apparatus as claimed in claim 16, wherein said controller comprises an ink level calculator for calculating an ink level in said storage chamber based on the ejected ink amount, and a flow rate calculator for calculating a flow rate per unit time of the ink through said ink port based on the calculated ink level, to decide based on the flow rate a time for opening said ink port to supply the ink to said negative pressure generator chamber by the amount according to the ejected ink amount.

20. The ink jet recording apparatus as claimed in claim 19, wherein said storage chamber contains an air-tight ink bag, said ink bag storing the ink, and having an ink spout joined to said ink port, and wherein said ink level calculator calculates the level of the ink stored in said ink bag.

21. The ink jet recording apparatus as claimed in claim 19, further comprising a temperature sensor for measuring temperature of the ink in said ink container, and an ink viscosity calculator for calculating a viscosity of the ink based on the measured ink temperature, wherein said flow rate calculator calculates the flow rate per unit time taking account of the ink viscosity.

22. The ink jet recording apparatus as claimed in claim 12, further comprising an ink level detector for detecting that the ink contained in said negative pressure generator chamber goes below a predetermined reference level, wherein said control device controls said ink port opening closing mechanism to supply the ink by a given amount to said negative pressure generator chamber when the ink level goes below the reference level in said negative pressure generator chamber.

23. The ink jet recording apparatus as claimed in claim 22, further comprising an ink run-out detecting device that judges that said ink container is running out of the ink when the ink level in said negative pressure generator chamber does not go above the reference level even after said control device controls said ink port opening closing mechanism to supply the ink to said negative pressure generator chamber.

* * * * *